US007325806B1

(12) United States Patent
Feola

(10) Patent No.: US 7,325,806 B1
(45) Date of Patent: Feb. 5, 2008

(54) METHOD OF PLAYING A BONUS WAGER

(75) Inventor: John Feola, Medford, MA (US)

(73) Assignee: New Vision Gaming & Development, Inc., North Reading, MA (US)

( * ) Notice: Subject to any disclaimer, the term of this patent is extended or adjusted under 35 U.S.C. 154(b) by 54 days.

(21) Appl. No.: 10/913,097

(22) Filed: Aug. 6, 2004

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,489,101 A * 2/1996 Moody ..... 273/292
5,839,731 A 11/1998 Feola
6,012,719 A 1/2000 Webb
6,237,916 B1 * 5/2001 Webb ..... 273/292
6,371,867 B1 4/2002 Webb
6,457,714 B1 10/2002 Feola
6,481,717 B1 * 11/2002 Richardelle ..... 273/292
6,612,927 B1 * 9/2003 Slomiany et al. ..... 463/16
6,698,759 B2 * 3/2004 Webb et al. ..... 273/292
2003/0122305 A1 * 7/2003 Malcolm ..... 273/292
2004/0070146 A1 4/2004 Snow
2006/0014577 A1 * 1/2006 Snow ..... 463/12
2006/0068863 A1 * 3/2006 Hughes ..... 463/13
2006/0084506 A1 * 4/2006 Yoseloff et al. ..... 463/42
2006/0131807 A1 * 6/2006 Schlumbrecht ..... 273/292
2006/0157934 A1 * 7/2006 Yoseloff et al. ..... 273/292

* cited by examiner

*Primary Examiner*—Eugene Kim
*Assistant Examiner*—Delores R. Collins
(74) *Attorney, Agent, or Firm*—Altman & Martin; Steven K. Martin

(57) ABSTRACT

A method of playing a game with at least one deck of cards where the game comprises the steps of affording a player the opportunity to place a bonus wager, dealing out the cards to each of a plurality of hands, forming a bonus hand from one card from each of more than one hand, and identifying the player as a winning player if the player placed the bonus wager and the bonus hand has a predetermined rank.

12 Claims, 3 Drawing Sheets

METHOD OF PLAYING A BONUS WAGER

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to games for gambling, more specifically, to a bonus wager on a game where a player can wager on the hand composed of the face up cards of several hands.

2. Description of the Related Art

Many casino table games offer bonus bets or jackpots where players may wager on occurrences that do not affect the outcome of the basic game. These types of bonus bets and jackpots are popular with players. An example of such a bonus bet is the game "21+3" disclosed in U.S. Pat. No. 6,012,719. The game is a standard blackjack game where the player is also given the option of placing a bonus wager on whether or not a three-card poker hand made of the player's first two cards and the dealer's face up card is of a certain rank. Another example of a bonus bet is disclosed in U.S. Pat. No. 6,402,147. The basic game is stud poker, where the player's hand is compared to the banker's hand. The player is also given the option of placing a bonus wager on the rank of the player's hand.

BRIEF SUMMARY OF THE INVENTION

It is an object of the present invention to provide an adjunct to a game for gambling that adds another way to wager on the game.

It is another object to provide a poker-like element to different types of games for gambling.

The present invention is a method of playing a game with at least one deck of cards where the game comprises the steps of affording a player the opportunity to place a bonus wager, dealing out the cards to each of a plurality of hands, forming a bonus hand from one card from more than one hand, and identifying the player as a winning player if the player placed the bonus wager and the bonus hand has a predetermined rank.

The present invention is a bonus wager based on a bonus hand composed of a card from each of a group of hands of a base game. The base game can be one of any number of games including poker, blackjack, baccarat, pai gow tiles, and pai gow poker. "Card" refers to any representation of a playing card or playing tile, whether real or virtual. The bonus wager can take the form of a bonus bet or a jackpot.

The base game is played on a playing surface that has a central dealer position with a plurality of player hand locations and a banker hand location. The playing surface also has a number of player positions that each have a symbol corresponding to each player hand location and a location for a bonus wager. The player chooses player hands by placing a wager on the corresponding symbol. To participate in the bonus wager, the player places a wager on appropriate the bonus wager location. After all wagers are placed, the dealer deals out the predetermined number of player and banker hands. The bonus hand, composed of cards from the player hands, is compared to a table of ranked hands to determine whether the player placing a bonus wager is a winner and the amount of winnings. Typically, the bonus hand will be ranked as a poker hand, but any form of ranking may be used. Optionally, the bonus hand is composed of cards from the player hands and the banker hand(s).

The present invention contemplates that the game may be played using other media, such as scratch or pull-tab tickets, video poker-type machines, personal computers, hand-held devices, slot machines, over an on-line computer network, or on another type of one-way or interactive gaming or entertainment equipment, such as keno-style or lottery-style equipment.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
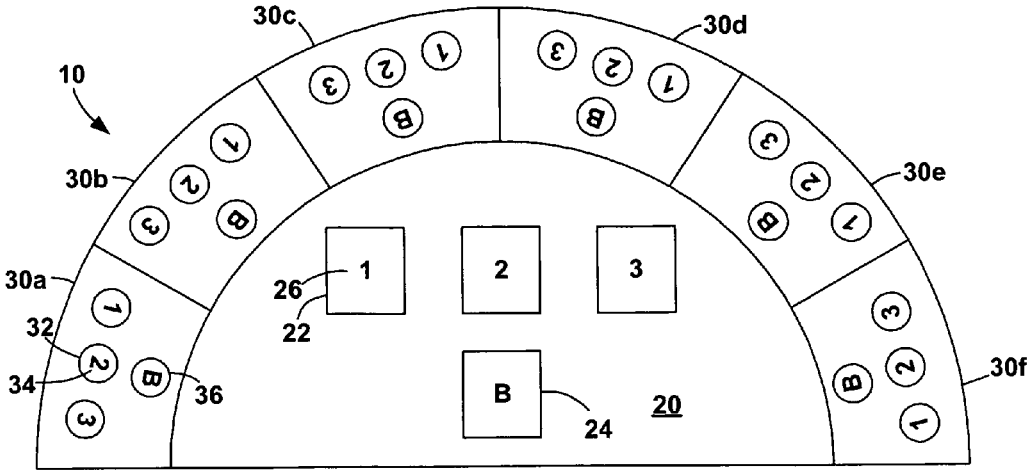
FIG. 1 shows a table layout of a game with three player hands and one banker hand incorporating a single bonus of the present invention.

The present invention is a bonus wager based on a bonus hand composed of a face up card from each hand of a group of hands of a base game. The base card game has a number of player hands where at least one card of each player hand and, optionally, the banker hand(s), is dealt face up. There are a number of such games in existence where the essence of the game, whether it based on poker, blackjack, baccarat, pai gow tiles, pai gow poker, or any other game, is that a player wagers on one or more of a group of hands that she hopes will beat a banker hand. Players do not control the hands, that is, no player hands are assigned to players. The dealer plays all of the hands according to rules that permit little or no discretion in how the hands are played. One such game for poker is disclosed in U.S. Pat. No. 5,839,731, Method and Apparatus for Playing a Casino Game. Another such game for blackjack is disclosed in U.S. patent application Ser. No. 10/867,019, Method of Playing a Blackjack-type Casino Card Game. Another such game for pai gow is disclosed in U.S. patent application Ser. No. 10/890,445, Method of Playing a Pai Gow-type Game.

The term "card" is used in the present application to indicate a playing card, a playing tile, or any facsimile thereof. For example, a card can be a paper playing card, a physical playing tile, an image of a card or tile on a video display, an image of a card or tile on a scratch ticket, etc. Any representation of a playing card or tile is contemplated. A "deck of cards" refers to one or more complete decks of playing cards or a set of pai gow tiles. A "hand" is the group of cards for a single position. When using playing cards, a hand consists of the cards placed at each player and banker position. When using tiles, a hand consists of the tiles placed at each player and banker position.

In general, there are several forms of bonus wagers. In the bonus bet, the bonus wager goes to the banker and any winnings are paid by the banker as a fixed multiple of the wagered amount. In a jackpot, the bonus wager goes into a pot and winnings are paid from the pot as a percentage of the pot and/or a fixed amount. If the jackpot falls below a predetermined minimum value, the banker may add to the pot to restore the minimum value. In a set jackpot, the amount put into the jackpot for each game is fixed, but the fixed amount may be adjusted periodically, for example, after the jackpot is won. If more than one player wins a set jackpot, each winner is paid a predetermined amount. In a progressive jackpot, the amount put into the jackpot increases for each game played during which the jackpot is not won. If more than one player wins a progressive jackpot, its value is divided equally among the winners. Optionally, the jackpots from more than one table may be linked together as a single jackpot.

Before game play begins, the house determines the rules with which the game will be played, including, for example, the base game, the number of player and banker hands, the number of bonus hands, the cards that are dealt face up, the cards used for the bonus hands, the rank of winning bonus hands, the type of bonus wager, and how winning bonus hands are paid.

Figure 3:
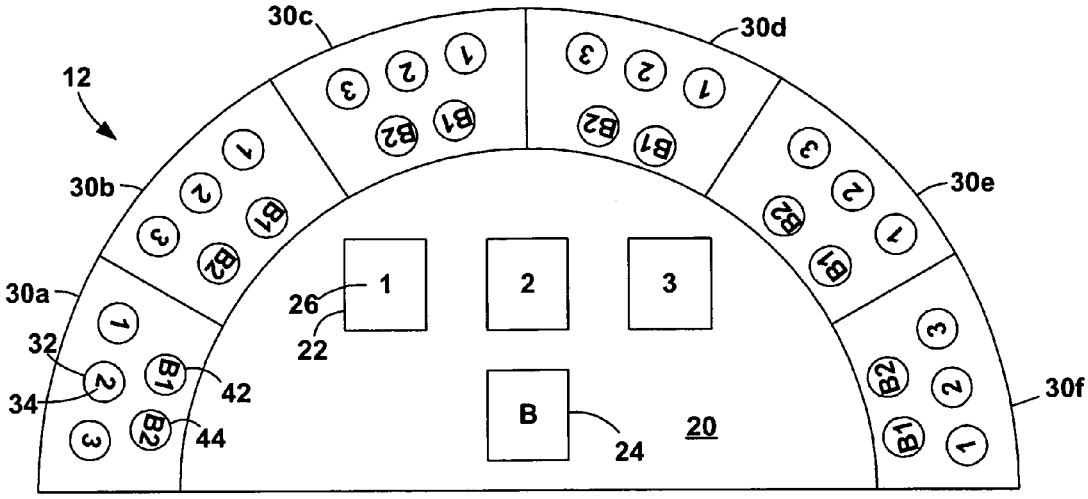
FIG. 3 shows a table layout of a game with three player hands and one banker hand incorporating two bonuses of the present invention.

The base game is played on a playing surface, typically a tabletop, although other playing surfaces are contemplated, as described below. Example playing surfaces 10, 12 for a base game with which the bonus wager of the present invention is played are shown in FIGS. 1 and 3. These playing surfaces 10, 12 are merely examples and any other playing surface configuration that provides the functionality needed to play the base game and incorporate the bonus wager of the present invention is contemplated.

The central dealer position 20 has a plurality of player hand locations 22, one for each player hand to be dealt. The dealer position 20 has a banker hand location 24 for the one banker hand. The symbols 26 at each player hand location 22 are the player hand identifiers, which are typically numerals running sequentially from "1".

There are a number of player positions 30*a*-30*f* (collectively, 30) that typically are evenly spaced in a semicircle around the dealer position 20. Each player position 30 includes a symbol 32 containing a player hand identifier 34 corresponding to each player hand location 22. Typically, there are six player positions 30, but because the number of players is not related to the number of player hands, the number of player positions 30 may vary. Each player position 30 also includes a bonus wager symbol. The example of FIG. 1 has a single bonus wager symbol 36 for one bonus and the example of FIG. 3 as two bonus wager symbols 42, 44 for two bonuses.

Figure 2:
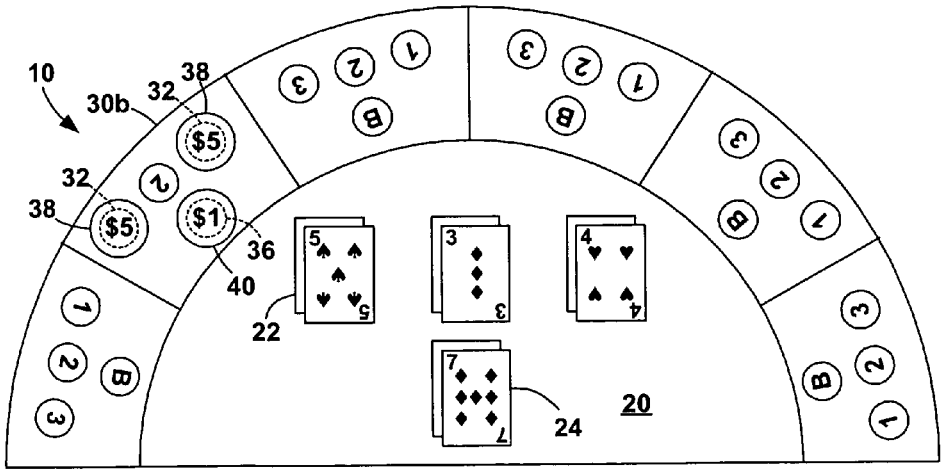
FIG. 2 shows the table layout of FIG. 1 with a blackjack hand dealt.
Figure 4:
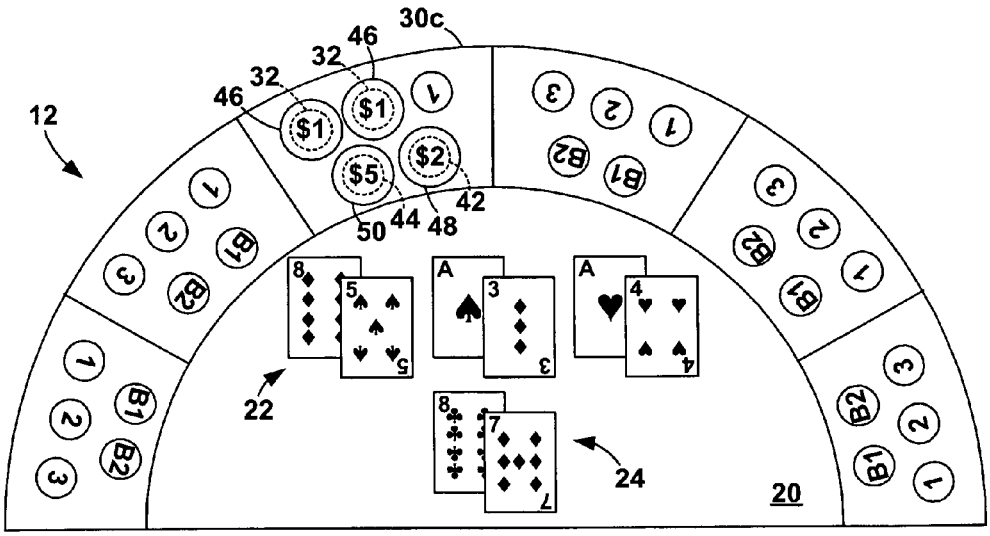
FIG. 4 shows the table layout of FIG. 3 with a blackjack hand dealt.

To begin the game, each player chooses the player hand or hands that she thinks will beat the banker hand in the base game. The selections are made by placing the amount to be wagered on the corresponding player hand identifier symbol 32 of the player position 30. The wagered amount is indicated by any marker or markers that acceptably signify value, such as cash, chips, or credit vouchers. In the example of FIG. 2, the player at the second player position 30*b* (player 2) has placed a $5 chip 38 on each identifier symbol 32 for player hands 1 and 3, wagering that player hands 1 and 3 will beat the dealer hand. In the example of FIG. 4, the player at the third player position 30*c* (player 3) has placed a $1 chip 46 on each identifier symbol 32 for player hands 2 and 3, wagering that player hands 2 and 3 will beat the dealer hand.

To participate in the bonus wager of the present invention, the player places the amount to be wagered on the appropriate bonus wager location. The amount to wager may be decided by the player or may be a fixed amount determined by the banker, for example, $1. If the player decides the amount of the wager, there will typically be a minimum and maximum permitted wager determined by the banker. As with the base game, the wagered amount is indicated by any marker or markers that acceptably signify value. In the example of FIG. 2, player 2 has placed a $1 chip 40 on the bonus wager symbol 36, wagering that the bonus hand will be a winning hand. In the example of FIG. 4, player 3 has placed a $2 chip 48 on the first bonus wager symbol 42, wagering that the first bonus hand will be a winning hand, and a $5 chip 50 on the second bonus wager symbol 44, wagering that the second bonus hand will be a winning hand.

After all wagers are placed, the dealer deals out the predetermined number of hands. In the two examples, the dealer deals out three player hands and a banker hand, placing them in the appropriate locations 22, 24 of the dealer position 20. Each hand is dealt the appropriate number of cards for the base game. For example, for five-card poker, five playing cards are dealt, for blackjack and baccarat, two playing cards are dealt, for pai gow tiles, four tiles are dealt, and for pai gow poker, seven playing cards are dealt.

The bonus hand of the present invention is composed of at least one card from each player hand. In the example of FIG. 2, the bonus hand is composed of the face up cards from each player hand, which means that the bonus hand is a three-card hand composed of a 5 of spades, a 3 of diamonds, and a 4 of hearts. In the example of FIG. 4, the first three-card bonus hand is composed of the first-dealt cards from each player hand: an 8 of diamonds, an ace of spades, and an ace of hearts. The second three-card bonus hand is composed of the second-dealt cards from each player hand: a 5 of spades, a 3 of diamonds, and a 4 of hearts. Optionally, the bonus hand is composed of cards from fewer than all of the player hands.

Optionally, the bonus hand is composed of at least one card from each player hand and the banker hand(s). With this option, the bonus hand of the example of FIG. 2 is a four-card hand composed of a 5 of spades, a 3 of diamonds, a 4 of hearts, and a 7 of diamonds. In the example of FIG. 4, the first four-card bonus hand is composed of an 8 of diamonds, an ace of spades, an ace of hearts, and an 8 of clubs. The second four-card bonus hand is composed of a 5 of spades, a 3 of diamonds, a 4 of hearts, and a 7 of diamonds. Optionally, the bonus hand is composed of cards from fewer than all of the player and banker hand(s).

Optionally, the cards that compose the bonus hand are dealt face up, as in the example of FIG. 2. When the bonus hand cards are dealt face up, the bonus wager of the present invention can be settled before continuing with the base game. Generally, if the bonus hand cards are dealt face down, the base game is completed and the cards revealed before the bonus wager can be settled.

The bonus hand is compared to a table of ranked hands to determine whether the bonus hand is a winning hand and the player placing a bonus wager is a winner and the amount of winnings. When the base game uses playing cards, the bonus hand is preferably treated as a poker hand and the bonus hand is compared to a table of poker rankings. Table 1 is an example of such a table for a three-card poker hand. Note that the example hand of FIG. 2 is a straight, which is a winning hand according to Table 1.

TABLE 1

| Hand | Bonus Bet Payout | Jackpot Payout |
|---|---|---|
| Royal Flush | 100-1 | 100% of Jackpot |
| Straight Flush | 40-1 | 25% of Jackpot |
| Three of a Kind | 30-1 | 10% of Jackpot |
| Straight | 6-1 | $10 |
| Flush | 4-1 | $5 |
| Pair | 1-1 | $1 |

The present invention contemplates that the bonus hand ranking may be determined by other conditions. One condition may be the sum of the values of the cards in the bonus hand. Table 2 is an example of such a table for a three-card hand.

TABLE 2

| Bonus Hand Sum | Bonus Bet Payout |
|---|---|
| 3 | 500-1 |
| 4-6 | 50-1 |
| 7-10 | 5-1 |
| 11-15 | 2-1 |
| 16-20 | 1-1 |

The players that played the bonus wager receive a predetermined amount of winnings that is determined by the rank of the bonus hand. The predetermined amount may be a multiple of the amount wagered, a percentage of a pot into which the bonus bet is placed, or a fixed amount. Tables 1 and 2 show examples of winning multiples under the "Bonus Bet Payout" column. For the example bonus hand of FIG. 2, player 2 wins $6 under the poker rankings of Table 1 because player 2 wagered $1 and the bonus hand is a straight, which pays 6-1. Under the sum rankings of Table 2, player 2 wins $2, because player 2 wagered $1 and the bonus hand has a sum of 12, which pays 2-1. Table 1 also shows an example of winning percentages under the "Jackpot Payout" column. Note that not all winnings are a percentage of the jackpot; some are fixed amounts. For the example bonus hand of FIG. 2, player 2 wins $10, because the bonus hand is a straight.

The present invention contemplates that, rather than being played on a table surface with a live dealer, the game is played using other media, such as scratch or pull-tab tickets, video poker-type machines, personal computers, hand-held devices, slot machines, over an on-line computer network, or on another type of one-way or interactive gaming or entertainment equipment, such as keno-style or lottery-style equipment.

Figure 5:
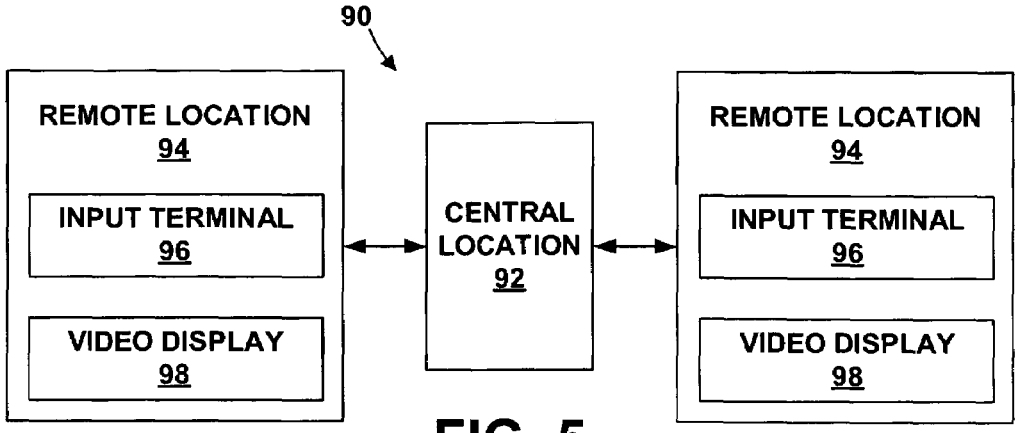
FIG. 5 shows a block diagram of a keno-style system implementing the basic game of the present invention.

In a keno-style lottery system 90, a block diagram of which is shown in FIG. 5, a player typically makes her choice of player hands at a remote location 94 by marking a slip of paper with the player hands she wishes to wager on, whether or not she wishes to play the bonus wager, and the wager amounts. She gives the slip to a clerk with the amount of the wager, who then scans the slip into a terminal 96 that sends the choices to a central location 92. Alternatively, choices can be made from keys on a keyboard, keys on a key grid, or by boxes on a touch screen grid. Alternatively, the player many request a "quick pick," where the input terminal 96 or central location 92 randomly chooses a hand or hands for the player. The player receives a receipt, such as a paper receipt, or other acknowledgement, such as an indication on a private terminal, indicating the hand or hands chosen for the game and if the bonus wager is played. As the game is being played, the hands are displayed on a video screen 98 or matrix of video screens visible to the players at the remote location 94 from information received from the central location 92.

Figure 6:
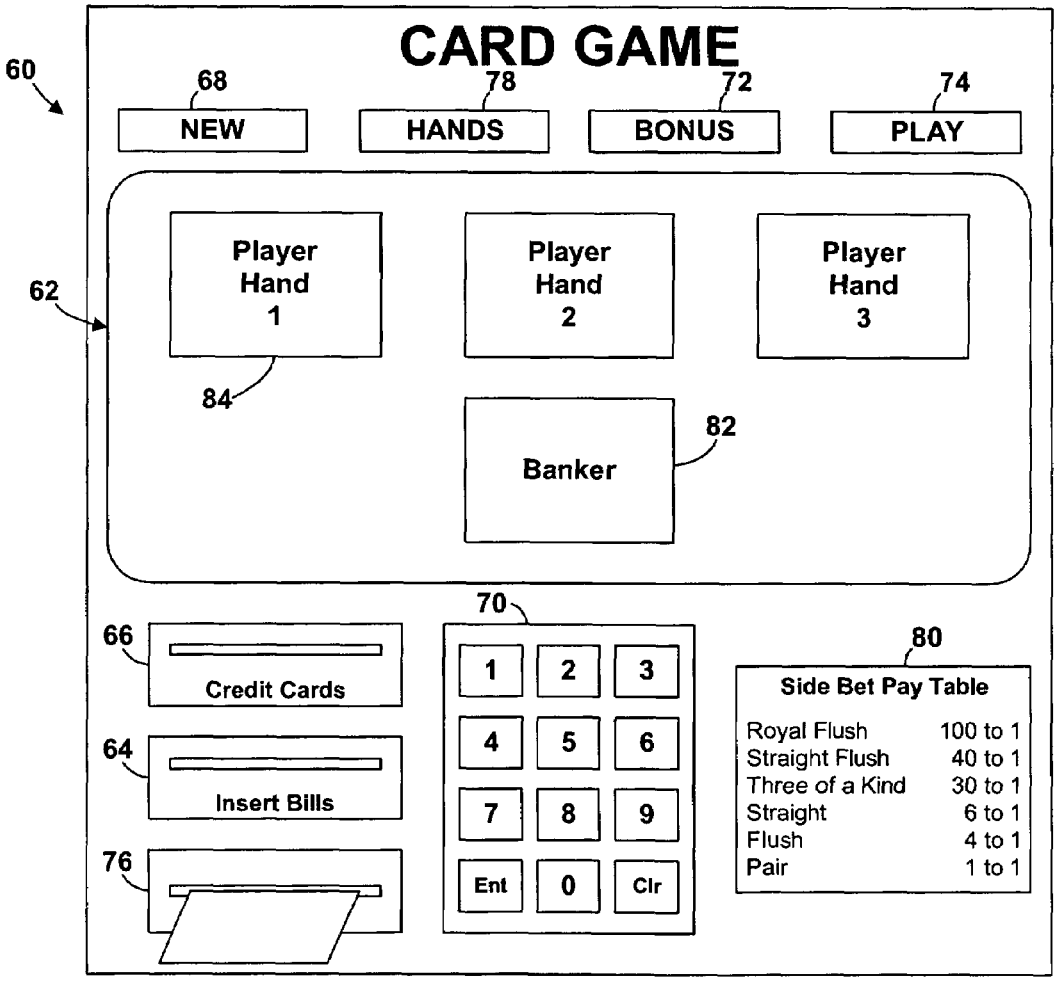
FIG. 6 shows a video screen implementing the game shown in FIG. 1.

With individual machines, an example of which is shown in FIG. 6, implementing the embodiment of FIG. 1, each player has her own terminal 60. An example is a video machine at a gaming establishment. The banker hand 82 and player hands 84 are displayed on the player's video screen 62. Prior to playing a game, the player inserts cash, a voucher, or a paper ticket, into a money reader 64 or swipes a credit card, debit card, or player card in a card reader 66. The player presses the NEW button 68 and indicates the amount to wager for the game, typically by entering an amount on the keypad 70. The player begins a game by pressing the HANDS button 78 and entering the player hands on which the player wishes to wager using the keypad 70 or a touch screen 62. If the player wishes to play the bonus wager, she presses the BONUS button 72 and indicates the amount to wager. The player presses the PLAY button 74 to deal the cards. If the player played the bonus wager, the rank of the bonus hand comprised of the face up cards of the player hands is compared to the table 80 of ranked hands for the bonus wager. If the bonus hand rank is in the table 80, the winning amount is credited to the player and may be printed on a voucher 76 for payment by a cashier or they may be paid in coins or other monetary tokens by the terminal itself. After the bonus wager is settled, the base game is completed and any winnings are paid out in the same fashion.

Alternatively, the standalone machine may be a personal computer, hand-held device, or mobile telephone. The standalone machine can be part of a wired or wireless network. Wagers can be made by debits to credit cards, debit cards, or other cash equivalent. Payouts can be made by crediting credit cards, debit cards, or other bank account, by dispatching gifts, or by any other method wherein the player is credited with the amount won.

Thus, it has been shown and described a bonus wager that satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A method of playing a game with at least one deck of cards, said game comprising the steps of:

(a) affording a player the opportunity to place a bonus wager;

(b) dealing out said cards to each of a plurality of hands;

(c) forming only one bonus hand from one of said cards from each of a subset of said plurality of hands;

(d) identifying said player as a winning player if said player placed said bonus wager and said bonus hand has a predetermined rank; and (e) paying said winning player a payout.

2. The method of claim 1 wherein said bonus hand is formed from cards that are dealt face up.

3. The method of claim 1 wherein said hands are player hands.

4. The method of claim 3 wherein said bonus hand is formed from one card from each of said player hands.

5. The method of claim 3 wherein said bonus hand is formed from cards that are dealt face up.

6. The method of claim 1 wherein said hands are player hands and at least one banker hand.

7. The method of claim 6 wherein said bonus hand is formed from one card from each of said player hands and one card from each of said at least one banker hand.

8. The method of claim 6 wherein said bonus hand is formed from cards that are dealt face up.

9. The method of claim 1 wherein said bonus hand is a poker hand.

10. The method of claim 1 wherein said payout is a multiple of said bonus wager.

11. The method of claim 1 wherein said payout is paid by a banker.

12. The method of claim 1 wherein said bonus wager is placed in a pot and said payout is paid from said pot.

* * * * *

(12) POST-GRANT REVIEW CERTIFICATE (235th)

United States Patent
Feola

(10) Number: US 7,325,806 J1
(45) Certificate Issued: Sep. 6, 2022

(54) METHOD OF PLAYING A BONUS WAGER

(75) Inventor: John Feola

(73) Assignee: NEW VISION GAMING AND DEVELOPMENT, INC.

Trial Number:

CBM2018-00005 filed Dec. 15, 2017

Post-Grant Review Certificate for:

Patent No.: 7,325,806
Issued: Feb. 5, 2008
Appl. No.: 10/913,097
Filed: Aug. 6, 2004

The results of CBM2018-00005 are reflected in this post-grant review certificate under 35 U.S.C. 328(b).

POST-GRANT REVIEW CERTIFICATE
U.S. Patent 7,325,806 J1
Trial No. CBM2018-00005
Certificate Issued Sep. 6, 2022

AS A RESULT OF THE POST-GRANT REVIEW PROCEEDING, IT HAS BEEN DETERMINED THAT:

Claims 1-12 are cancelled.

* * * * *